US006029758A

United States Patent [19]

Novacovicci et al.

[11] Patent Number: 6,029,758

[45] Date of Patent: Feb. 29, 2000

[54] RETRACTABLE CORE BARREL VALVING APPARATUS

[75] Inventors: Radoie Novacovicci, Carp; Daniel H. Morin, North Bay, both of Canada

[73] Assignee: Boart Longyear International Holdings, Inc., Salt Lake City, Utah

[21] Appl. No.: 08/976,884

[22] Filed: Nov. 24, 1997

[51] Int. Cl.[7] ..... E21B 25/02

[52] U.S. Cl. ..... 175/234; 175/236; 175/246

[58] Field of Search ..... 175/234, 235, 175/236, 246, 247, 257

[56] References Cited

U.S. PATENT DOCUMENTS

| | | | |
|---|---|---|---|
| 3,120,283 | 2/1964 | Braun | 175/246 |
| 3,126,064 | 3/1964 | Miller | 175/246 |
| 3,266,835 | 8/1966 | Hall et al. | 294/86.24 |
| 3,333,647 | 8/1967 | Karich et al. | 175/247 |
| 3,461,981 | 8/1969 | Casper et al. | 175/246 |
| 3,485,310 | 12/1969 | Milosevich | 175/246 |
| 4,800,969 | 1/1989 | Thompson | 175/246 |
| 4,832,138 | 5/1989 | Hallez | 175/247 |
| 5,020,612 | 6/1991 | Williams | 175/234 |
| 5,325,930 | 7/1994 | Harrison | 175/246 |
| 5,339,915 | 8/1994 | Laporte et al. | 175/244 |

*Primary Examiner*—Eileen Dunn Lillis
*Assistant Examiner*—Sunil Singh
*Attorney, Agent, or Firm*—Clayton R. Johnson

[57] ABSTRACT

The drilling apparatus includes a wire line core barrel having a head assembly and a drilling tool connected to the head assembly. The head assembly includes a latch body with a landing shoulder seatable on the drill string landing ring, latches seatable in a drill string latch seat and a fluid bypass channel for bypassing from one axial side of the landing shoulder to the other, a bushing in the bypass channel, a valve member movable in the channel from an axial outer bypass channel open position and an axial inner second position extending into the bushing for one of blocking axial inward fluid flow through the bushing and restricting inward flow through the bushing. A spring is provided in the bore inwardly of the bushing for abutting against the valve member in its second position to urge the valve member axially outwardly. A latch retractor is mounted to the latch body for movement relative thereto between a latch seated position and a latch retracted position for retracting the latch body through the drill string and valving mechanism connected to the latch retractor for moving the valve member in the fluid channel to the valve member outer open position. An overshot coupling device retracts the latch retractor and thereby retracts the latches and pull the ball portion outwardly of the bushing to decrease resistance to drilling fluid flow inwardly through the bushing.

24 Claims, 6 Drawing Sheets

RETRACTABLE CORE BARREL VALVING APPARATUS

BACKGROUND OF THE INVENTION

This invention relates to drilling apparatus and more particularly to valving mechanism that is mechanically forced to move axially outwardly through a bushing reduced diameter portion seat as the overshot coupling mechanism is moved to retract the latches.

U.S. Pat. No. 5,325,930 to Harrison discloses a toggle linkage movable to an overcenter position for locking the latches in a latch seated position and for retracting the latches.

U.S. Pat. No. 5,339,915 to Laporte et al discloses a one way retention valve in a core barrel inner tube assembly that functions to retain drilling liquid pressure in lost circulation situations resulting from, for example, drilling into a cavity or into a broken earth formation. However, with such apparatus, the descent in a drill string is very slow since the fluid bypass channel is blocked and liquid can not bypass except around the exterior of the latch body landing shoulder. Further, a heavy duty spring is used to create a high liquid pressure and retain a column of liquid above the core barrel inner tube assembly. This high pressure, in combination with pump surging, has resulted in wear on the valve ball seat. The ball essentially hammers the seat which, over a period of time, damages the seat. Also, spring pressure has to be constantly adjusted to compensate for wear and the adjustment affects the gap between the core lifter and bit.

U.S. Pat. No. 5,020,612 to Williams discloses a core barrel inner tube assembly having a resilient ring (bushing) in the fluid bypass channel through which a valve ball is forced inwardly by fluid under pressure when the inner tube assembly is in its core collecting position at the bit end of the drill string.

U.S. Pat. No. 3,333,647 to Karich et al discloses a core barrel inner tube assembly having spring mechanism acting between a latch body and a latch release tube to constantly urge the latch release tube to a position permitting the latches moving to a latch seated position.

In order to make improvements in valving mechanism operable in a fluid bypass channel that bypasses the latch body landing shoulder of drilling apparatus and controls the head of fluid axially outwardly of the bypass channel, this invention has been made.

In United States Patent application Ser. No. 08/802,557, now U.S. Pat. No. 5,904,393 there is disclosed a resilient valve seat in a fluid bypass channel in a core barrel inner tube assembly wherein a valve ball is forced axially inwardly through the seat by fluid under pressure and resiliently urged outwardly toward the valve seat after having passed through it to maintain at least a minimum fluid pressure head in the drill string. However, at times in bore holes in which there is a very low water table and the valving assembly retains a large column of water in the drill string relative to the water table level exterior of the drill string, it is difficult to pull the core barrel inner tube assembly outwardly of the inner end of the drill string.

In order to make improvements in valving mechanism in a fluid bypass channel that bypasses the latch body landing shoulder of drilling apparatus and controls the head of fluid axially outwardly of the bypass channel, this invention has been made.

SUMMARY OF THE INVENTION

A drilling assembly that is movable in a drill string to the inner end portion thereof for being latchingly retained therein includes a latch body having latch retracting mechanism mounted thereon for limited axial movement relative thereto for retracting the latches of the latch assembly from a latch seated position. The latch body is of a two part construction with each latch body part defining a part of a fluid bypass channel having a chamber in which there can be removably mounted one or more of valving assembly, a bushing and a spring urging the valving assembly outwardly after the valve mechanism has been forced at least partially through the bushing. The valve assembly is retracted outwardly of the bushing by retracting the latch retractor. A drilling tool is attached to the latch body to extend inwardly thereof, the tool being any one of, for example, a core barrel inner tube, a plug bit, an earth sampling tube, and etc.

One of the objects of this invention is to provide new and novel means in drilling apparatus that is latchingly coupleable in a drill string to provide a high pressure signal at the drilling surface when said apparatus is in position to latchingly couple to the drill string. In furtherance of the above object, it is another object of this invention to provide in a drilling apparatus head assembly, new and novel means to substantially restrict or block fluid flow through a fluid bypass channel therein, together with being movable to maintain a desired fluid head in the drill string, and thereafter being mechanically retractable to to an axially outer open position in the channel as the head assembly is retracted in the drill string.

A different object of this invention is to provide in drilling apparatus that has a fluid bypass channel for bypassing a drill string landing shoulder, new and novel valving mechanism for controlling the head of fluid in the drill string and facilitating the withdrawal of the drilling apparatus when the head of fluid in the drill string results in a greater than desired withdrawal force having to be applied, taking into consideration the head of fluid in the drill string. In furtherance of the last mentioned object, it is an additional object of this invention to provide new and novel valving mechanism in the bypass channel that is movable to an open position by retracting a latch retractor.

For purposes of facilitating the description of the invention, the term "inner" refers to that portion of the drill string, or of the assembly, or an element of the assembly being described when, in its position "for use" in, or on, the drill string is located closer to the drill bit on the drill string (or bottom of the hole being drilled) than any other portion of the apparatus being described, except where the term clearly refers to a transverse circumferential, direction, or diameter of the drill string or other apparatus being described. The term "outer" refers to that portion of the drill string, or of the assembly, or an element of the assembly being described when, in its position "for use" in, or on, the drill string is located axially more remote from the drill bit on the drill string (or bottom of the hole being drilled) than any other portion of the apparatus being described, except where the term clearly refers to a transverse circumferential, direction, or diameter of the drill string or other apparatus being described.

DETAILED DESCRIPTION OF THE INVENTION

Figure 1A:
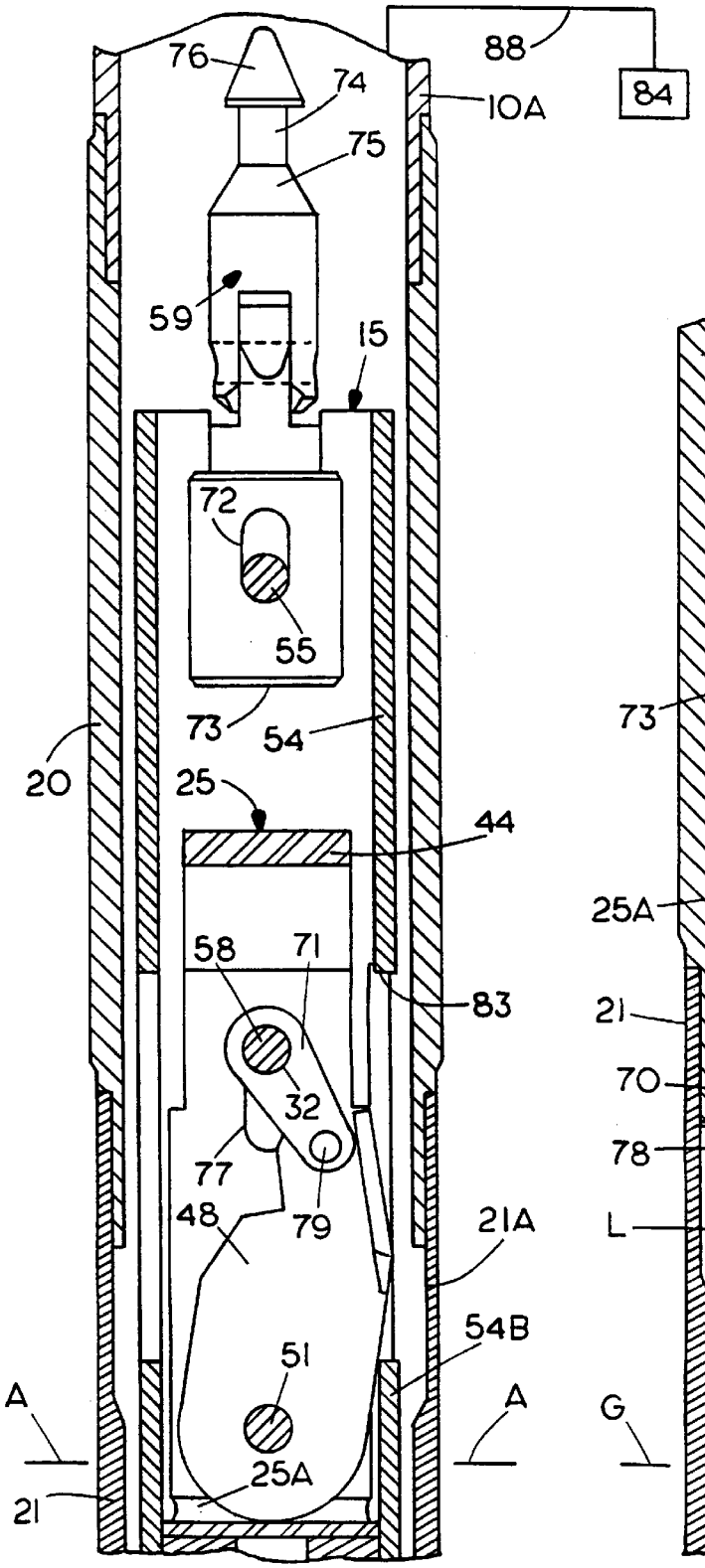
FIGS. 1A, 1B and 1C when arranged one above the other with the axial center lines aligned and lines A—A and B—B of FIGS. 1A and 1B aligned, and lines E—E and F—F of FIGS. 1B and 1C aligned, form a composite longitudinal section through the drilling apparatus of the first embodiment of the invention just prior to core barrel inner tube assembly seating on the landing ring, other than one latch is shown and axial intermediate portions are broken away; said view being generally taken along the line and in the direction of the arrows 1A, 1B-1A, 1B of FIG. 4.

Referring now in particular to FIGS. 1A, 1B, 1C, 2A, 2B, and 3, there is illustrated a hollow drill string 10 which is made up of a series of interconnected hollow drill rods (tubes). The drill string 10 is in a downwardly extending bore hole 12 drilled in rock or other types of earth formations by means of an annular core bit 11. The pump apparatus located at the drilling surface and indicated by block 84 pumps fluid under pressure through line 88 into the outer end of the drill string 10 in a conventional manner, the illustrated part of the drill string 10 in FIGS. 1A, 1B and 1C being located just upstream of the bit in the bore hole 12 and may be at a considerable depth below the drilling surface.

The portion of the drill string attached to or extended below the pipe (rod) section 10A is commonly referred to as a core barrel outer tube assembly, generally designated 13, the core barrel outer tube assembly being provided for receiving and retaining the core barrel inner tube assembly, generally designated 15, adjacent to the bit end of the drill string. Details of the construction of the core barrel outer tube assembly used in this invention may be of the general nature such as that disclosed in U.S. Pat. Nos. 3,120,282 and 3,120,283. The outer tube assembly is composed of an adaptor coupling 21 that is threadedly connected to the core barrel outer tube 18 to provide a recess in which a landing ring (drill string landing shoulder) 27 is mounted, a reaming shell 19 joined to the inner (lower) end of tube 18 and an annular drill bit 11 at the inner end of the reaming shell for drilling into the earth formation from which the core sample is taken. The outer end of the assembly 13 includes a locking coupling 20 that connects the adaptor coupling to the adjacent pipe section 10A of the drill string. At the opposite end of the coupling 20 from the pipe section 10A, the locking coupling, in conjunction with the annular recess of the coupling 21, form a latch seat 21A inside of the surface of the adaptor coupling against which the latches 47, 48 of the latch assembly L are seatable for removably retaining the core barrel inner tube assembly 15 adjacent to the core bit. The inner end portion of the locking coupling may have a conventional projection flange (not shown) to bear against a latch to cause the latches and other portions of the inner tube assembly to rotate with the drill string when the latches are in a latched position, as is conventional.

The core barrel inner tube assembly 15 includes a latch body, generally designated 25, having a main body portion 44 with an enlarged diametric flange 44C to provide an annular, downwardly facing shoulder 30 and an inner body portion 43. The main body portion has an inner, reduced outer diameter part 44A extended into and threadedly connected to the inner body portion axial outer annular part 43A. Parts 43A and 44A in conjunction with latch body enlarged diametric annular flanges 44C and 43E cooperatively provide a radially outward annular groove to removably mount a latch body ring 24 that is seatably retained in abutting relationship to shoulders 30 and 43B that in part define a groove in which the ring 24 is retained (see FIGS. 1B and 3). Thus, the latch body ring provides a latch body shoulder that is seatable on the drill string shoulder (landing ring) 27, the landing ring and flanges 44C and 43E cooperatively providing a maximum enlarged diameter latch body portion. It is to be understood that in place of a landing ring 27, either one or both of flange 44C and the axial outer part of latch body portion 43 may be of a larger outer diameter to provide a latch body landing shoulder seatable on the drill string landing shoulder.

The latch body portions 43 and 44 cooperatively provide a fluid bypass channel F having inlet ports 52 opening to an axial bore (chamber) 57 inwardly of the bore outer end and outwardly of the shoulder 30, and outlet ports 53 that open to the bore 57 axially inwardly of a metal bushing 49. The fluid bypass channel F permits fluid flow to bypass the landing ring 27 and the latch body ring 24 when the ring 24 is seated on the ring 27. That is, the portions of the inner tube assembly from the latch body ring 24 and axially inwardly and outwardly of ring (maximum diameter latch body portion) 24 are of smaller maximum diameters than the maximum outer diameter of ring (latch body shoulder) 24 while the channel has ports 52 opening exterior of the latch body axially outwardly of the ring 24 to the annular clearance space outwardly of the ring 24 and radially between the latch body and the drill string and second ports 53 opening exterior to the annular clearance space axially inwardly of the ring 24 and radially between the latch body and the drill string. The latch body landing ring, when seating on the drill string landing ring, blocks or severely restricts axial inward flow therebetween.

A bushing 49 constitutes part of a two way liquid retention valve mechanism, generally designated 40, for controlling fluid flow through the latch body fluid bypass channel F. The bushing is mounted in an axially intermediate diameter portion 57X of the bore 57 which is formed in the latch body inner part to abut against a transverse outwardly facing annular shoulder 50 with the bushing being located axially intermediate of the opening of the ports 52 and 53 to bore 57 and axially inwardly of part 44A (see FIGS. 3 and 6). The minimum diameter (cylindrical surface portion 49B) of the bushing when mounted in bore 57 is substantially smaller than any portion of the bore 57 axially intermediate the openings of the inlet and outlet ports thereto. Axially inwardly of the opening of the ports 53 to bore 57, there is a further reduced diameter bore portion to provided an annular, axially outwardly facing shoulder 93 to have the inner end of a coil spring 98 abut thereagainst. The opposite end of the spring is abuttable against the axial inner transverse surface of the bushing or is closely adjacent thereto.

The valve mechanism 40 also includes valving assembly V that comprises a valve ball member 99. The valve ball member 99 is axially movable in the bore 57 and has an inner ball portion 99B which is partially spherical and of a maximum diameter that is less than the minimum diameter of the bushing cylindrical surface portion 49B but less than the maximum diameters of the frustoconical surfaces of the bushing portions 49A and 49C and is axially movable through bushing as will be more fully set forth hereinafter. The major base diameters of the frustoconical surfaces are axially remote from one another. In a transverse plane perpendicular to the central axis of the valving mechanism and the drill string, and passing through the center of curvature R of the spherical part of the ball member, the diameter of the ball member portion 49B is less than the minimum diameter of the juncture of the bushing frustoconical portions to the bushing portion 49B.

Figure 6:
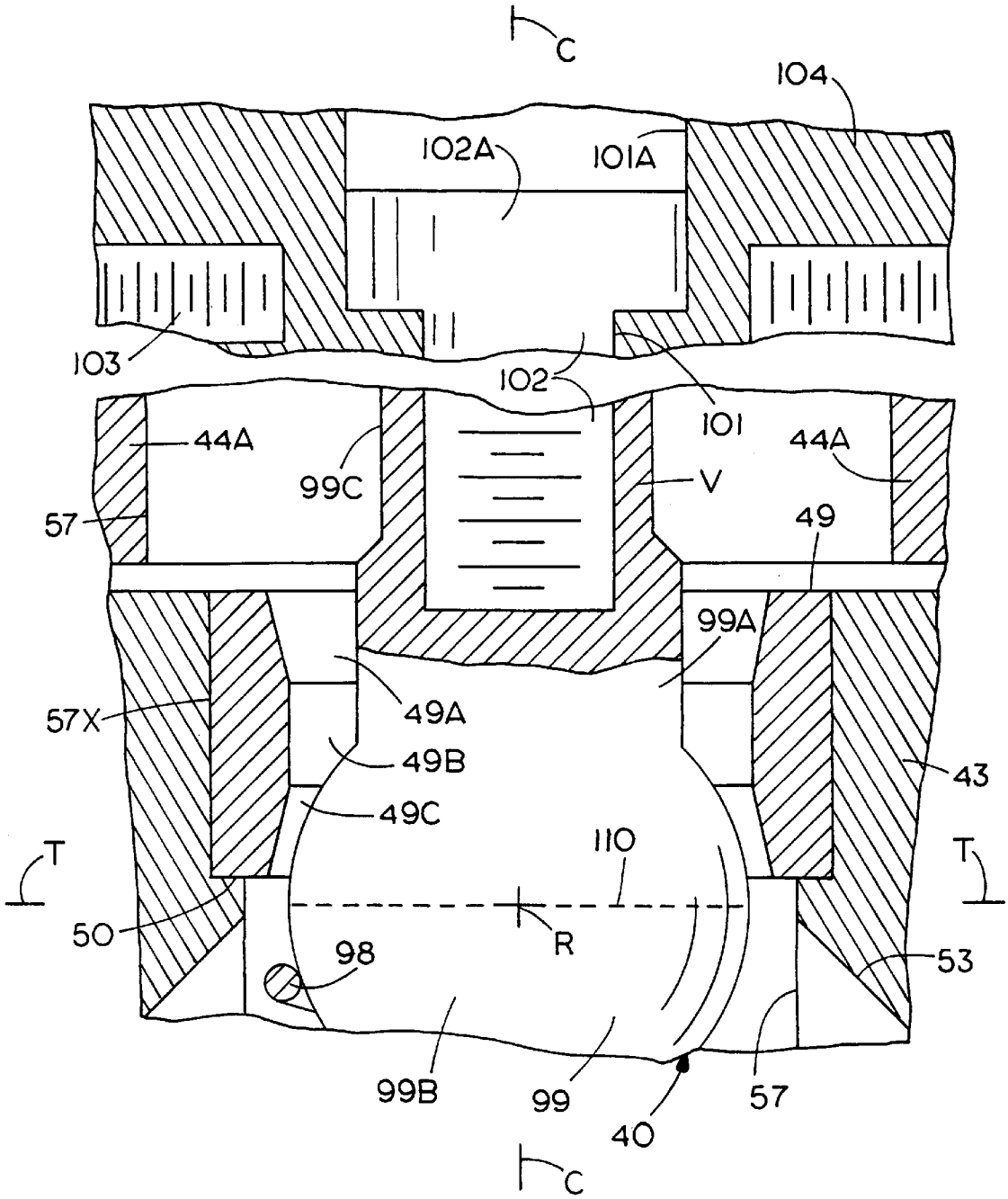
FIG. 6 is an enlarged fragmentary sectional view showing the valve mechanism ball portion of the first embodiment being retained sufficiently inwardly of the inner valve seat by fluid under pressure to permit increased fluid flow axially inwardly through the fluid bypass channel.

Preferably, the ball member portion 99B has a maximum transverse diameter section, indicated by dotted line 110 in FIG. 6, in the transverse plane T—T which is perpendicular to the central axis of the latch body C—C and passes through the center of curvature R while the diameters in parallel planes progressively decrease both inwardly and outwardly from plane T—T. The diameter of the section 110 may be smaller or greater than the minimum inner diameter of the axial intermediate cylindrical surface portion 49B of the bushing opening, depending upon whether the valve assembly is to restrict fluid flow through the bushing or to block fluid flow through the bushing when abutting against the outer valve seat 49A before being forced inwardly by fluid pressure. With the bushing being made of metal, the maximum diameter of section 110 is slightly less than the inner diameter of bushing portion 49B.

Joined to the non-spherical part of the ball portion of the valve ball member to extend axially outwardly is a cylindrical portion 99A which has flats 99C at its outer end to facilitate being threadingly mounted to a valve stem (shaft) 102. In the plane of the central axis C—C of the valve assembly, the ball portion 99B extends arcuately through an angle greater than 180 degrees, for example 250 degrees, while the maximum diameter of curvature of the valve member cylindrical portion in a plane transverse to the axis C—C is substantially less than that of the diameter of the ball member and the minimum diameter of the bushing.

The valve stem is axially slidably extended in an axial bore 101 in the transverse, generally cylindrical stem mount 104. The stem mount is mounted in a fixed axial position to and within the inner end portion of the latch retractor (tube) 54 by screws 103 to move axially therewith. The valve stem mount 104 in turn mounts the valve stem for limited axial movement relative thereto. The valve ball portion is movable axially inwardly to have its maximum transverse diameter section to extend inwardly of the junction of bushing portions 49B and 49C when the latch body ring has landed on the drill string landing shoulder and is in a position for latchingly engaging the drill string latch seat and is movable axially outwardly through the bushing to be axially outwardly of the bushing by retracting the latch retractor relative to the latch body.

The outer end portion 101A of the bore 101 is of an enlarged diameter to have the enlarged diameter head portion 102A of the valve stem axially and rotatably movable therein to limit the axial inward movement of the valve stem inwardly relative to the stem mount. When and as the latch retractor 54 moves to its axial inner position relative to the latch body as will be set forth hereinafter, the ball portion is movable from a position axially outwardly of the bushing to permit maximum fluid flow through the bushing and an axial inner position to have its maximum diametric section radially aligned with bushing portion 49B to restrict inward fluid flow through the bushing and a position to have said diametric section inwardly to the bushing portion 49B such as shown in FIG. 6 to permit permit increased fluid flow through the bypass channel. The axial outward movement of the ball member relative to the stem mount is limited by one of the ball portion 99A abutting against the stem mount and the valve stem abutting against the wall part 105 which defines the outer end portion of the axially elongated slot 107 that extends transversely diametrically through the latch body main portion 44.

Figure 3:
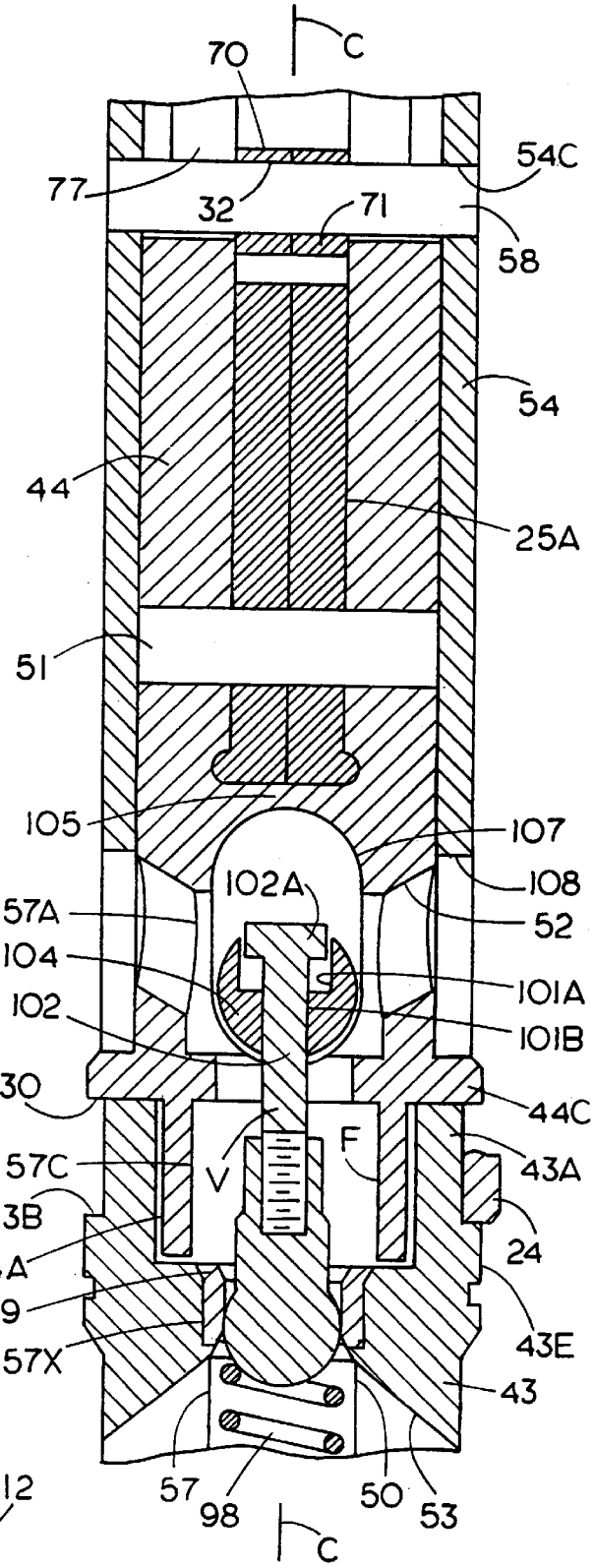
FIG. 3 is a fragmentary longitudinal sectional view of the first embodiment that is generally taken along the line and in the direction of the arrows 3—3 of FIG. 4 with the valve ball portion abutting against the valve assembly spring prior to having its transverse englarged diametric portion being forced axially inwardly of the bushing minimum diameter diametric portion.
Figure 1C:
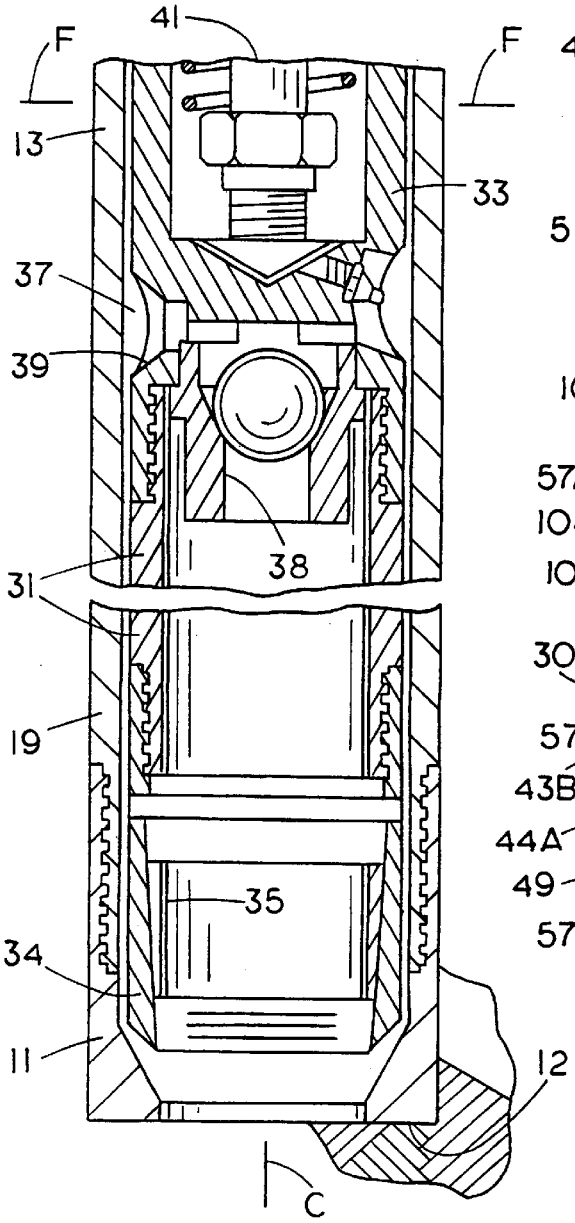
Figure 4:
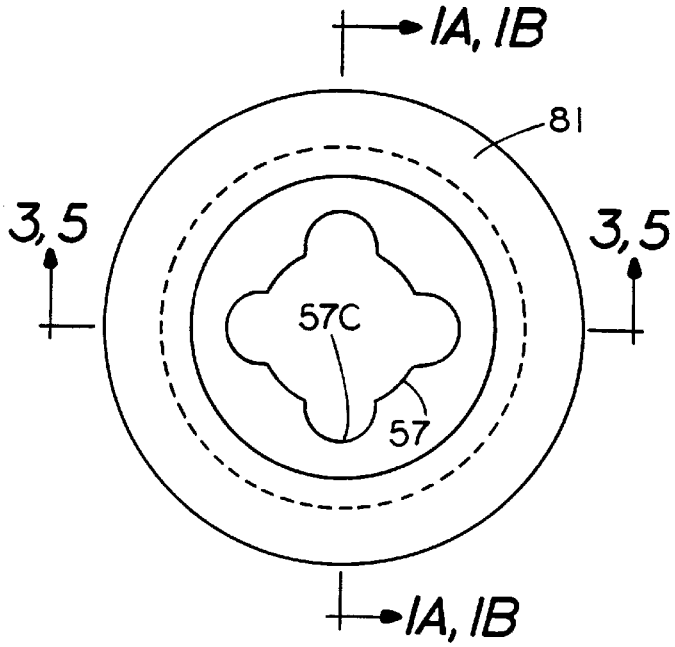
FIG. 4 is a transverse axial inner end view of the latch body outer portion of the first embodiment.
Figure 5:
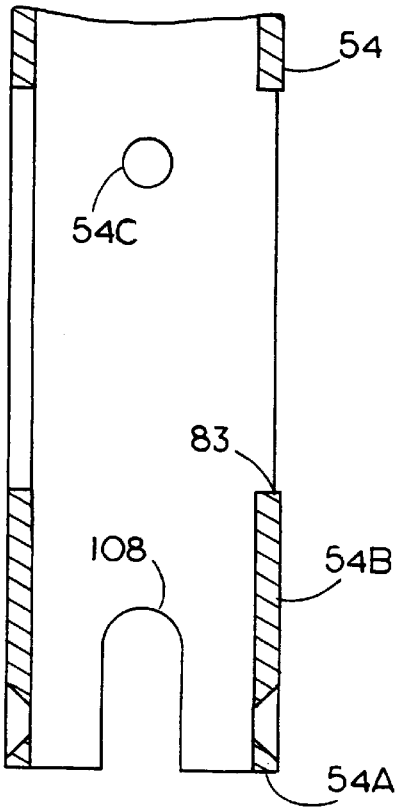
FIG. 5 is a fragmentary longitudinal sectional view of the inward end portion of the latch retractor tube that is generally taken along the line and in the direction of the arrows 5—5 of FIG. 4.

The stem mount axially movably extends through the stem mount slot 107 with either the slot 107 and/or the movement of the retractor pin 58 in the latch body retractor pin slot 77 limiting the axial movement of the stem mount relative to the latch body. The slot 107 opens to the axial outer bore portion 57A of bore 57 axially inwardly of the outer end of the bore portion 57A (see FIG. 3) with at least the major part of the stem mount being movable outwardly of the opening of the ports 52 to bore portion 57A. Bore portion 57A is formed in the main body portion of the latch body with the diameter of the stem mount being substantially less than the maximum transverse dimension of the bore portion 57A. The transverse shape of the fluid channel portion 57C in the latch body main portion axially inwardly of the annular flange 44C may be of the transverse shape such as shown in FIG. 4. When the stem mount is in its innermost position relative to the latch body, the major part of the stem mount is axially outwardly of the inwardmost part of the opening of the ports 52 to bore portion 57A. Thus, the stem mount and valve stem do not significantly reduce fluid flow through the bypass channel F.

Figure 1B:
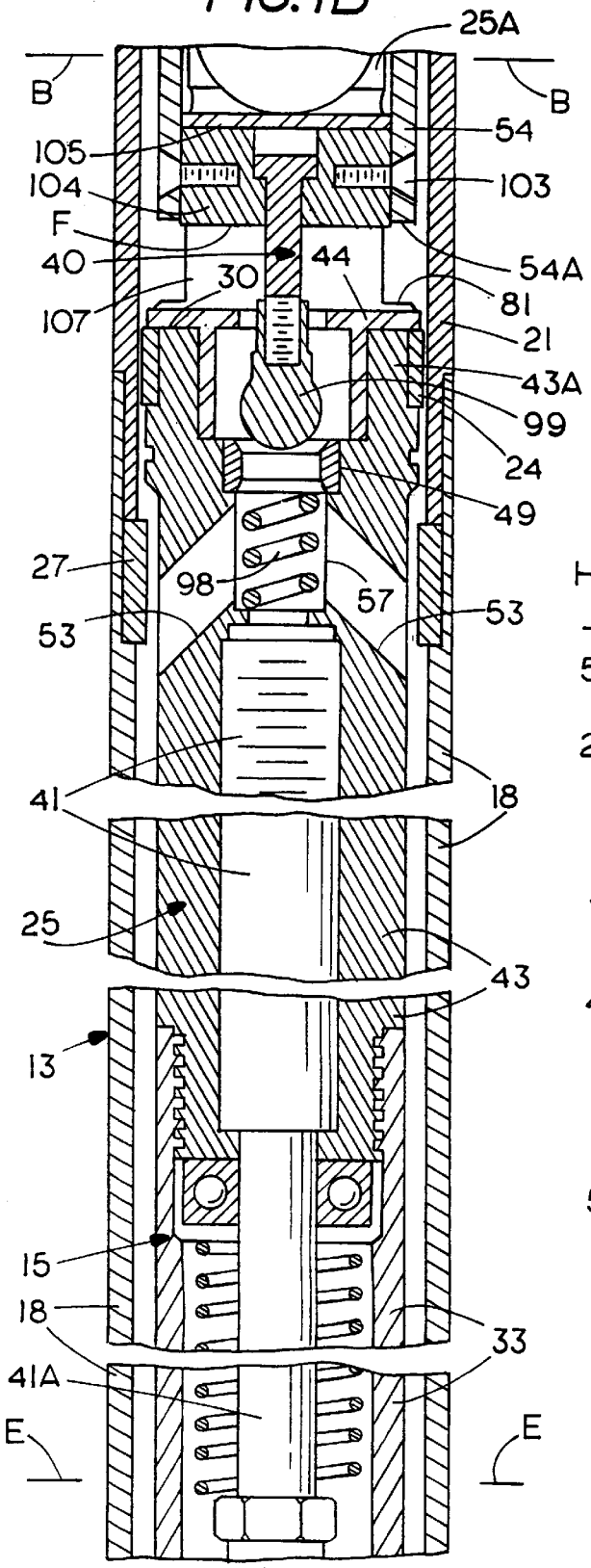

When the latch retractor is retained in axial spaced relationship to the annular flange 44C as a result of the drill string preventing the latches 47, 48 moving to their extended latch seated position such as shown in FIGS. 1A, 1B, the inner terminal edge 54A of the latch retractor is maintained in axial spaced relationship to the annular flange 44C and the latch retractor may in part block the radially outward opening of some of the ports 52 to the drill string. When the latches are in a latch seated position with retractor inner edge 54A abutting against annular flange 44C, the retractor has notches 108 that open inwardly through the inner edge 54A and extend outwardly the same distance that radially adjacent ports 52 extend to form part of the fluid bypass channel F when the core barrel inner tube is in a core taking position, see FIG. 3. Advantageously, the parallel axial extending edges of the notches are of a spacing about the same as the diameter of the ports 52.

The assembly 15 also includes a core receiving tube 31, an inner tube cap 33 threaded into the outer end of the core receiving tube, and a spindle and bearing subassembly 41 for connecting the cap to the inner portion of the latch body. The subassembly 41 includes a spindle bolt 41A threadedly connected to the inner end portion of the latch body, and connects the cap to the latch body for limited movement in a conventional manner. The core receiving tube has a replaceable core lifter case 34 and a core lifter 35, the structure and function of which may be generally the same as set forth in U.S. Pat. No. 2,829,868. A fluid passageway 39 formed in the cap 33 opens through a valve subassembly 38 to the interior of the outer end of the core receiving tube and at the opposite end to the annular clearance space 37 between the inner tube assembly and the outer tube 18 that forms a part of the annular fluid channel 37 to, in conjunction with the latch body bypass channel, permit fluid to bypass the inner tube assembly when in a core taking position. The cap 33 is mounted by the spindle-bearing subassembly 41, the subassembly 41 and the manner of the mounting thereof being very similar to that described in greater detail in U.S. Pat. No. 3,305,033.

The core barrel inner tube assembly also includes a latch assembly L having the pair of latches 47, 48 with their axial inner end portions pivotally mounted in a latch body slot 25A by a pivot member 51 that is mounted to the latch body. Pin 58 mounts the latch retractor (release) tube 54 to the latch body for limited axial movement relative thereto for retracting the latch assembly from its latch seated position to its latch release position and alternately permitting the latch assembly moving to its latch seated position when the latches are radially adjacent to the latch seat. A pin 55 is fixedly mounted to the outer end portion of the latch retractor tube and is extended through an axially elongated slot 72 in the plug 73 of the overshot coupling device, generally designated 59. Thus, the plug 73 may be moved relative to the latch retractor tube to an axial inner position and an axial outer position. The device 59 includes a spear point 76 that is joined by a reduced diameter neck 74 to the minor base of the frustoconical portion 75. Even though the overshot coupling device 59 shown may be of substantially the same construction as that described in U.S. Pat. No. 4,281,725 and functions in the same manner, it is to be understood that other overshot coupling devices can be used.

Figure 2A:
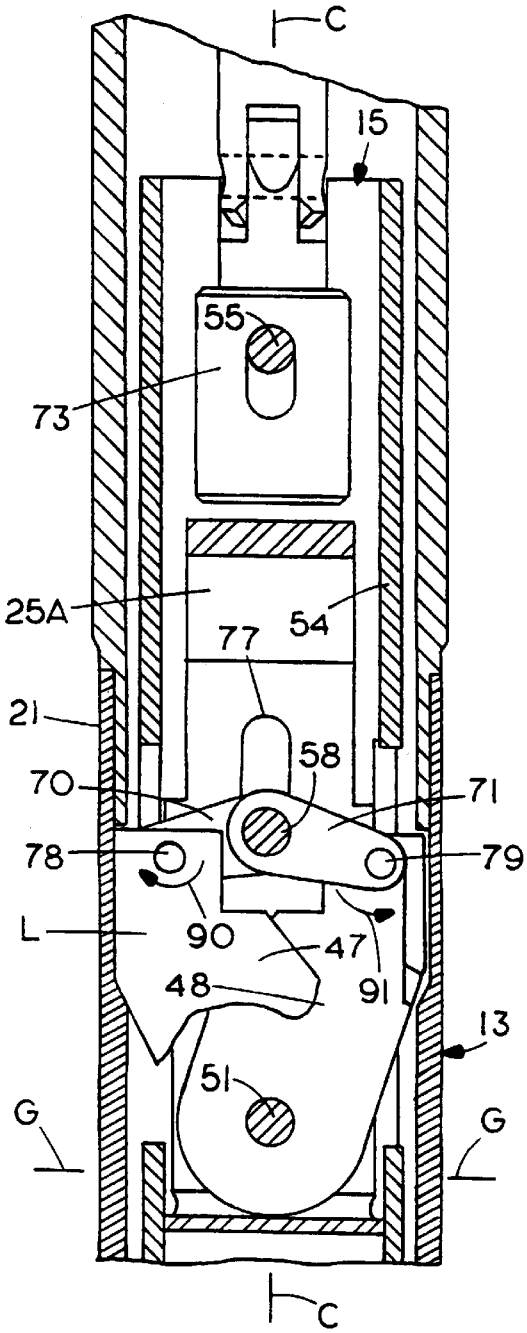
FIGS. 2A and 2B when arranged one above the other with the axial center line aligned and lines G—G and H—H aligned, form a fragmentary composite longitudinal section through the drilling apparatus of the first embodiment that is the same as FIGS. 1A and 1B, other than the core barrel inner tube assembly is in its drilling position and the valve mechanism is in its inward position and various portions are broken away or not shown.
Figure 2B:
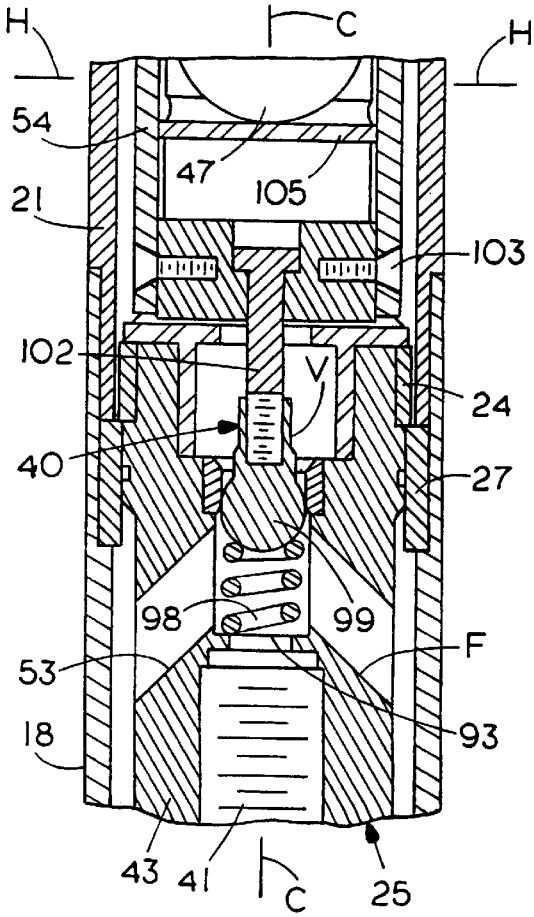

The latch assembly L also includes a toggle linkage subassembly having generally transversely elongated toggle link members that include toggle links 70, 71 pivotally mounted by pivot link pins 78, 79 to the axial outer ends of portions of the latches 47, 48 respectively for pivotal movement between a latch retracted position and an extended latch seated position of FIG. 2B (or an overcentered locked position, if the slot 77 extends further inwardly than shown, for example such as shown in the above mentioned patent to Harrison). A horizontally extending retractor pin 58 extends transversely through link apertures 32 and the axially elongated slot 77 of the latch body. The opposite ends of the pin 58 are mounted within opposed apertures 54C in the latch retractor tube in fixed axial relationship to the retractor tube and form a lost motion pivotal connection between the latch body, the latches and the latch retractor tube. The axial outward movement of the latch retractor tube relative to the latch body is limited by the pin 58 abutting against the outer edges of the latch body that in part define slots 77 and the axial inward movement is limited by one of the pin 58 abutting against the axial inner edges of the slots 77 and the annular, axial inner edge portion 54A of the latch retractor tube abutting against the annular flange 44C. The pin 58 retracts the latch body when the pin 58 abuts against the outer ends of the slots 77.

The pivotal movement of the radial inner ends of the links 70, 71 relative to the latch body in a predominantly inward direction (arrows 90 and 91 respectively) is limited by the retractor pin 58 bottoming on the inner edges of slots 77. When the core barrel inner tube assembly is in its core taking position of FIGS. 2A and 2B with the latches in their latch seated position, the inner annular edge 54A of the latch retractor tube abuts against the axially outwardly facing shoulder 81 of the annular flange 44C. Even though the latches are extendable radially outwardly through the retractor tube slots 83 and the axial inner ends of slots 83 are in part defined by the axially inner retractor tube portion 54B, the portion 54B may or may not abut against latches to retract the latches from their latch seated position as the retractor tube is retracted. Advantageously the slots may be angularly spaced relative to the slots 108.

Figure 7:
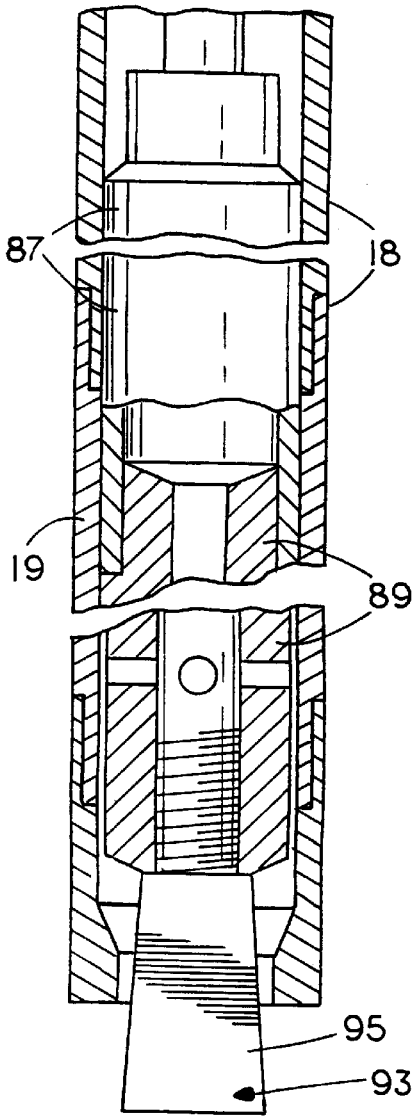
FIG. 7 is an axial cross sectional view of the inner end portion of a second embodiment of the invention which shows a drag bit.

The second embodiment of the invention (see FIG. 7), generally designated 93, includes a latch body, a latch assembly, valving mechanism and latch retracting mechanism that may be the same as that disclosed with reference to FIGS. 1A, 2A and 2B. However, instead of the spindle subassembly 41, there is provided a conventional earth sampler spindle 87 that at its outer end is threadedly connected to the inner body portion 43 of the latch body and at its inner end is threadedly connected to a drag bit mounting sub 89. The sub 89 threadedly mounts a drag bit 95 to extend through and inwardly of the drill bit 11. The sub is of a type that rotates the drag bit when the bit 11 is rotated.

As may be apparent from the above description, the latch body, latch assembly, valve mechanism and the latch retracting mechanism, including the overshot coupling device provide a head assembly that may be attached to a variety of drilling tools or devices that are to be inserted in a drill string and removably latched to the inner end portion of the drill sting.

In using the apparatus of this invention, for example, the core barrel inner tube assembly of either the first or second embodiment, the inner tube assembly is inserted into the outer end of the drill string and as the assembly moves inwardly (axially downwardly), the latches may abut against the transverse inner surface of the drill string to limit the movement of the latches to remain adjacent to their retracted positions of FIG. 1B. The pin 55 in abutting against the inner end of slot 72 and pin 58 abutting against or being adjacent to the outer end of slots 77 (if the inner tube assembly is being lowered by an overshot assembly) and/or the latches abutting against the drill string retain pin 58 to prevent the latch retractor tube moving to have its edge 54A abut against the shoulder 81 but not to prevent the latches initially moving toward their latch seated position such as shown in FIG. 1A. While the pin 58 prevents the retractor tube moving to abut against the enlarged diametric portion 44C, the valve ball portion is retained in a fluid bypass channel open position with not more than a small part of the ball portion 99B, if any, extending inwardly of a part of the bushing such as shown in FIG. 1B.

As the latch body shoulder 27 moves to seat on the drill string landing ring, the latches move axially adjacent to the latch seat whereby the latches can pivot toward and to their latch seated position and are pivoted to their latch seated position. As the latches pivot toward their seated position, the pin 58 and the latch retractor tube can move axially inwardly toward and to the shoulder 81 under gravity and or fluid pressure. That is, the outer ends of the latches pivot radially outwardly of the inner tube assembly central axis C—C to seat in the latch seat as a result of the weight of the retractor tube and overshot coupling member and/or the fluid pressure acting on the retractor tube and the overshot coupling member. At this time, the movement of the latches results from the links pivoting in the direction of the arrows 90, 91 respectively relative to the outer ends of the latches.

When the latch body ring seats on the drill string landing ring and as the latches move to their latch seated position, the retractor tube 54 moves axially toward the flange 44C, the valve assembly V is permitted to move and, if abutting against wall portion 105, is forced to or moves toward the bushing. Prior to the retractor tube abutting against the annular flange 44C, the valve ball portion abuts against the spring 98 to stop the inward movement of the valving assembly whereby, upon the retractor tube abutting against the annular flange, the valve stem head portion is axially outward of the shoulder of the stem mount formed by the juncture of bore portions 101A, 101B such as shown in FIG. 3. When the ball portion has moved to abut against the spring, the maximum transverse diametric section of the ball portion is radially aligned with the bushing intermediate portion 49B to sustantially restrict inward fluid flow (limit inward flow to leakage flow) through the bypass channel and provide a high pressure signal at the axial outer end of the drill string and the inner tube assembly is in a core taking position. In the event one or both of the latches do not move to their latch seated position of FIG. 2A, the pin 58 abuts against the outer ends of slots 77 to prevent the retractor tube moving to abut against the annular flange 44C. As a result, the ball member is prevented from moving inwardly to have its maximum transverse diametric section moving into the bushing intermediate portion to substantially restrict fluid flow through the bushing to provide a high pressure signal that the core barrel inner tube assembly is in a latch seated position.

Upon increasing the pump-in fluid pressure or if the pump-in pressure is sufficiently high, the fluid force acting on the valving assembly V forces ball member inwardly to compress the spring 98 with the ball member maximum transverse diametric section 110 sufficiently inwardly of the bushing portion 49B to be radially opposite the bushing portion 49C such as shown in FIG. 6 to increase the annular clearance space. Thus, the annular clearance space between the ball portion and the bushing increases with increasing pump-in fluid pressure to permit increased rate of fluid flow through the bushing and thereby increased axial inward flow through the bypass channel F.

When, because of a core jam in the inner tube or the desired length of core has been taken, the core drilling is stopped together with retracting the drill string sufficiently to break the core from the earth formation, the pumping in of drilling fluid is discontinued and a conventional overshot assembly (not shown) is inserted into the drill string to move to couplingly engage the overshot coupling device 59. If the pumping in of fluid is discontinued or the pump-in pressure is decreased, the spring 98 moves the ball portion outwardly to have its transverse maximum diametric section radially opposite bushing portion 49B to restrict inward fluid flow through the bushing. With the ball member in abutting relationship to the spring 98, the initial retraction of the overshot coupling device acts to apply a retraction force to pin 55, if not already applying such a force, to retract pin 55. The retraction of pin 55 retracts the latch retractor tube which moves the stem mount outwardly to retract the ball member and pull it through the bushing to be axially outwardly of the bushing such as shown in FIG. 1B. As the transverse maximum diameter section of the ball member that is at right angles to the drill string central axis is moved axially outwardly of bushing portion 49B, the resistance to drilling fluid (liquid) flowing axially inwardly through the bushing is substantially decreased. As the retractor tube is moved axially outwardly, either the retractor tube moves the pin 58 to act through the toggle linkage, or if such linkage is not used but with spring mechanism (not shown) urging the latches to their latch seated position, the inner edges of the latch slots 83 abut against the latches to retract the latches. Prior to the pin 58 abutting against the outer ends of latch body slots 77, the ball member has been moved sufficiently outwardly relative to the bushing to permit an increased rate of fluid flow through the fluid bypass channel whereby as the latch body is retracted, the rate of drilling fluid flow through the bypass channel F increases to substantially decrease the force required to move the inner tube assembly outwardly through the drill string and to break any suction force that resists the initial retraction of the inner tube assembly.

Figure 8:
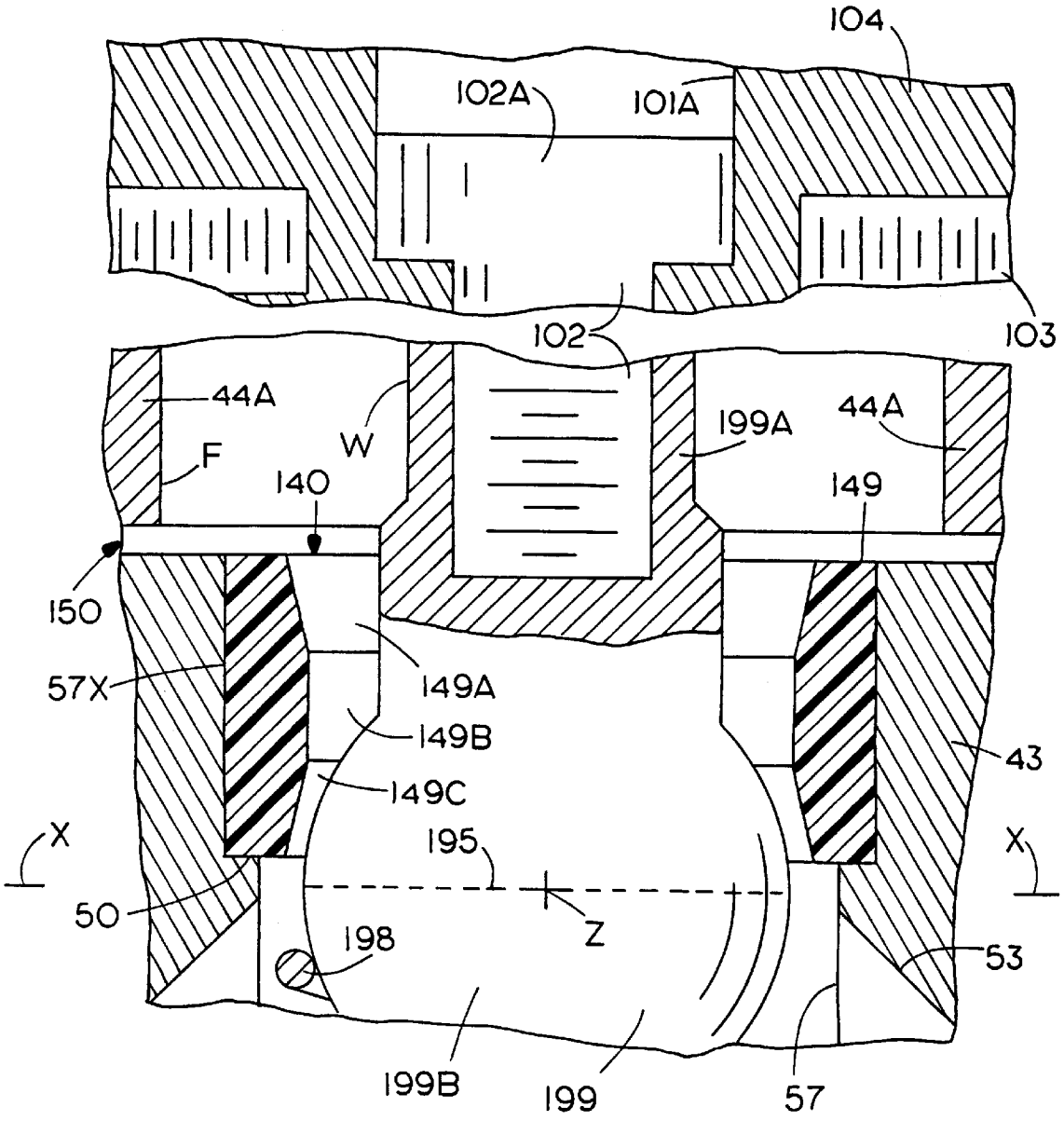
FIG. 8 is a longitudinal cross sectional view similar to FIG. 6 other than it is of a third embodiment wherein the bushing is of a resilient material and the ball portion is of a larger transverse diameter than the minimum transverse diameter of the bushing.

Referring to FIG. 8, the third embodiment of the invention, generally designated 150, is the same as the first embodiment except for the differences set forth below. The third embodiment includes valving mechanism, generally designated 140, having a valve assembly W mounted in the fluid bypass channel F and a resilient bushing 149 instead of the bushing 49 of the first embodiment which preferably is made of metal. The bushing 149 has an opening therethrough that is defined by axial outer frustoconical valve seat surface portion 149A, an axial inner frustoconical valve seat cylindrical surface portion 149C and an axial intermediate cylindrical surface portion 149B extending between the minor bases of the frustoconical portions 149A, 149B.

The valve assembly W includes a valve ball member 199 that is axially movable in the bore 57 and has an inner ball portion 199B which is partially spherical and of a maximum diameter that is greater than the minimum diameter of the bushing cylindrical surface portion 149B but less than the maximum diameters of the frustoconical surfaces of the bushing portions 149A and 149C and is axially movable through bushing as will be more fully set forth hereinafter. The major base diameters of the frustoconical surfaces are axially remote from one another. In a transverse plane perpendicular to the central axis of the valving mechanism and the drill string, and passing through the center of curvature Z of the spherical part of the ball member, the diameter of the ball member portion 199B which extends angularly through more than 180 degrees is greater than the minimum diameter of the juncture of the bushing frustoconical portions to the bushing portion 149B. The part of the ball portion 199B which extends inwardly of the plane X—X, as is the part of the ball portion 49B which extends below plane T—T, are semi-spherical. Preferably, the ball member portion 199B has a maximum transverse diameter section, indicated by dotted line 195 in FIG. 8, in the transverse plane X—X which is perpendicular to the central axis of the latch body C—C and passes through the center of curvature Z while the diameters in parallel planes progressively decrease both inwardly and outwardly from plane X—X. It is to be understood the diameter of the section 195 may be smaller or greater than the minimum inner diameter of the axial intermediate cylindrical surface portion 149B of the bushing opening, depending upon whether the valve assembly is to restrict fluid flow through the bushing or to block fluid flow through the bushing when abutting against the outer valve seat 149A before being forced inwardly by fluid pressure.

Joined to the non-spherical part of the ball portion to extend axially outwardly is a cylindrical portion 199A. Cylindrical portion 199A is mounted to a valve stem 102 which in turn is mounted to stem mount 104 such as disclosed with reference to the first embodiment.

During use, the ball member 199 which has a maximum diametric section 195 of a diameter larger than the inner diameter of bushing section 149B is seatable on the axial outer frustoconical surface portion (axially outwardly facing valve seat) 149A of the bushing 149 to block fluid flow through the bypass channel in an axial direction from the inlet ports 52 to the outlet ports until the pump-in fluid pressure exceeds a preselected level, but not block flow in the opposite direction. The valve ball member, in seating against the bushing portion 149A as indicated in the preceding sentence, provides a landing indicator (high pressure) signal at the drilling surface to indicate the latch body landing ring is seated on the drill string ring. Upon the ball member abutting against bushing portion 149A, the stem mount 104 continues to move downwardly relative to the valve stem until the retractor tube abuts against the enlarged diametric flange of the latch body.

The valve ball member and the bushing axial intermediate (minimum diameter) portion 149B are of diameters and the bushing is of a resiliency that the valve ball will not pass through the bushing until after a preselected high pump-in fluid pressure has been exerted on the ball member with the core barrel inner tube assembly seated on the landing ring 27 and then the ball member passes sufficiently inwardly through the bushing to abut against the spring 198. After the ball member has passed sufficiently inwardly through the bushing, the spring may retain the ball member in abutting relationship to the bushing frustoconical inner end portion (axially inwardly facing valve seat) 149C to block inward fluid flow through the bypass channel until fluid under pressure at the inlet ports 52 is at a second preselected high pressure that is greater than that required to force the ball through the bushing, provided it is desired to maintain a preselected head of fluid pressure in the drill string axially outwardly of the landing ring 27 to reduce chance of blockage from lost circulation, or the spring may be of characteristics such that the fluid pressure required to move the ball relative to bushing portion 149C to permit fluid bypass is less than that required to push the ball portion through the bushing. The choice of the characteristics of the spring 198 used depends on the characteristics of the earth formation from which a core sample is being obtained.

The spring 198 resists the movement of the ball member to the position of FIG. 8 whereby the desired head of fluid is retained in the drill string axially outwardly of the bushing and if it decreases below the desired level, for example as a result of the pump-in pressure decreasing, the spring 198 forces the ball member to abut against bushing portion 149C to block axial inwardly flow through the bypass channel. Thus, during normal operations while the drill string is moving axially inwardly during a coring operation, the drilling fluid pressure retains the ball member 199 in a position relative to the bushing such as shown in FIG. 8 to provide an annular clearance fluid bypass space between ball portion 199B and valve seat 149C.

If the ball portion section 195 is inwardly of the bushing portion 149B and the diameter of section 195 is larger than inner diameter of portion 149B, the decrease in pump-in pressure results in the ball portion abutting against valve seat 149C. Thence the retraction of the third embodiment is similar to the first embodiment with the retraction of the valve stem mount 104 moving the valve section 195C through bushing portion 149B and outwardly of the bushing to a position corresponding to the position of ball member 99 shown in FIG. 1B.

If desired, either one or both of bushings 49, 149 and/or the valve ball member 99, 199 (with unthreading of screws 103) may be replaced by unthreading and rethreading the latch body portions. Thus, if desired, the bushing 149 may be replaced with one having greater or less resiliency or a larger or smaller minimum diameter or a valve ball member portion 199B of a larger or smaller diameter if it is desired to provide an open or less restricted fluid bypass channel at a different pump-in fluid pressure. Further, the valve stem may be replaced with one of different selected lengths.

By providing a spring having characteristics to maintain a predetermined head of fluid (liquid) in the drill string, there will be fluid flow to maintain a stream of fluid to the bit end of the drill string even though fluid does not return to the drilling surface exterior of the drill string due to drilling in broken ground. By using a resilient bushing or a non-resilient bushing such as described, the valve ball member 99 or 199 is sufficiently axially outwardly relative to ports 52 to permit rapid descent of the core barrel inner tube assembly in a downward direction and once the latch body landing ring seats on the drill string landing ring and the latches move to their latch seated position, the ball member moves down to seat on the resilient bushing to block axial inward flow through the bushing or severely restrict fluid flow through the bushing to provide a high pressure signal at the drilling surface, or to move to a position such as previously described relative to the first embodiment, depending upon the relative diameters of the ball member maximum diameter transverse section and the inner diameter of the bushing intermediate section.

Each of the embodiments of the invention in drilling in a downward direction may advantageously utilize a valve ball member (undersize valve ball member portion) that is of a smaller diameter than the minimum inner diameter of the axial intermediate portion of the respective bushing to permit the valve ball moving axially through the bushing with the ball diameter being sufficiently large to substantially restrict axial inward flow through the bushing. Thus, as used herein, an "undersized valve ball member" refers to one wherein, with the ball portion axially and transversely centered with reference to the bushing minimum diameter portion, there is a clearance, desirably annular, between the valve ball portion and the bushing which permits a leakage stream of liquid passing therebetween. Advantageously, the bushing has an axial outer frustoconical portion that is centered with reference to the latch body central axis and its minor base axially inwardly of its major base to facilitate the valve ball member moving axially and transversely to the bushing minimum diameter portion in the fluid bypass channel.

Each of the valve ball portion 99B and 199B is of a larger diameter than the inside diameter of the axial outer helix turn of the respective coil spring 98 and 198 which extends arcuately through at least 360 degrees. As a result, when the drilling direction is downwardly and the inner tube assembly is in its latch seated position with no axial inwardly fluid flow, with the first embodiment, the coil spring 98 resiliently retains the valve ball member 99 to extend axially into the bushing such that its maximum transverse diametric section is radially aligned with bushing intermediate portion 49B and the valve stem head portion is retained axially outwardly of the stem mount shoulder defined by bore portions 101A and 101B, and with the third embodiment, if diametric section 195 is of a maximum diameter smaller than the inner diameter of portion 149B, the stem head portion is likewise retained in a similar position relative the stem mount shoulder. If the ball section 195 is of a larger diameter and is outwardly of the juncture of bushing portions 149A, 149B, the stem head is retained further outwardly than referred to in the preceding sentence.

When the inner tube assembly is in its latch seated position and the ball section 195 is of a larger diameter than the bushing minimum diameter portion and is inwardly of said diameter portion, the ball portion is resiliently retained inwardly of the bushing intermediate portion 149B, or if ball section 110 is in radial alignment with bushing portion 49B, there is a resistance to the initial retraction of the inner tube assembly which in part may be due to a suction force and/or the head of fluid in the drill string outwardly of the bushing. However, with the undersize valve ball portion, the axial inward leakage between the bushing and ball portion and/or movement of the valve assembly moved outwardly of the bushing does away with or minimizes such suction effects prior to the initial retracting force being applied to the latches and latch body allowing the head of fluid to drain once the pumping in of fluid is discontinued.

Advantageously the bushing 149 is made of plastic, preferably of Nylon, with the minimum inner diameter of the bushing and the diameter of the valve ball portion 199B being of relative dimensions to prevent the ball portion 199B moving axially inwardly through the bushing under gravity. As one example of the third embodiment but not otherwise as a limitation thereon, the minimum internal diameter of the Nylon bushing may be about 0.85" and the valve ball portion 99B of a diameter of about 0.87" with or without a spring being provided in latch body bore if the valve ball portion is to be forced axially inwardly through the bushing by pump-in drilling fluid (liquid) pressure to give a high pressure landing signal at the drilling surface; and if the valving mechanism is to be used as a water (drilling fluid) retention valve, a smaller ball portion (undersize valve ball portion) or a bushing having a larger minimum inner diameter of, for example of a diameter of about 0.88" with the ball portion of a diameter of about 0.87", may be used and pushed axially inwardly in the bushing wherein high pump pressure is required to force the valve ball portion maximum transverse diametric section inwardly of the bushing portion 149B and for abutting against and/or compressing the spring 198. Advantageously, no spring 198 is utilized if the diametric section 195 is larger than the inner diameter of portion 149B. As an example, if a metal bushing is to be used, the inner diameter of the bushing intermediate portion may be about 0.88" and the transverse maximum diameter section of the ball portion about 0.87". Regardless of whether or not an undersize valve ball portion is used, the outer diameter of the bushing is the same.

With each of the embodiments, the latch body landing ring may be easily replaced by unthreading the latch body main body portion from the inner body portion. Likewise, any one or more of the valve spring 98 and bushing and may be replaced or not used with the desired one or more of the valve assembly elements.

By providing a fluid bypass channel and valving mechanism of a construction of this invention, under certain drilling conditions, less force is required to retract the inner tube assembly than otherwise would be required in that the valve assembly is mechanically moved to its outer fluid bypass channel open position prior to a retraction force being applied to the latch body. Also, when an undersized valve ball member is used and it is located to have its maximum transverse diameter section radially aligned with the bushing intermediate portion, there is provided an annular leakage clearance space of a transverse area that advantageously is less than about 2 to 5 percent of the area of said section and preferably closer to 2 percent.

Even though, as disclosed above, there is provided a single latch pivot, it is to be understood that there may be provided two latch pivots in parallel relationship with one latch being pivotally mounted by each latch pivot as long as the latch pivots and the link pivots are located such that the links and latches will move between latch seated and latch retracted positions.

We claim:

1. A drilling head assembly having an axially extending central axis and being axially movable in a drill string to a bit end of the drill string to a position adjacent to the bit end of the drill string to latchingly engage a drill string latch seat and being retractable axially outwardly through the drill string in a direction outwardly of the bit end, comprising an axially elongated latch body having an enlarged diametric portion, a first end portion extending axially outwardly of the diametric portion, a second end portion extending axially inwardly of the diametric portion end portion, a fluid bypass channel that includes an axially extending bore, a first port opening radially outwardly axially outwardly of the enlarged diametric portion and opening to the bore and a second port opening radially outwardly axially inwardly of the enlarged diametric portion and opening to the bore axially inwardly of the first port opening to the bore, a latch mounted to the latch body for movement between a latch seated position and a latch retracted position, retractor means mounted to the latch body for limited axial movement relative to the latch body between an axial inner position and an axial outer position to retract the latch body, said retractor means extending axially outwardly of the enlarged diametric portion and including an overshot coupling device, and valving mechanism for controlling fluid flow through the bypass channel, the valving mechanism including a bushing mounted in the bore axially intermediate the openings of the ports to the bore and a valve assembly extending within the bore for movement relative to the latch body between an axial outer fluid channel open first position and an axial inner second position more closely adjacent to the bushing than in its outer position for cooperating with the bushing to one of substantially restricting inward fluid flow through the bushing and blocking inward fluid flow through the bushing, the valve assembly being connected to the retractor means for being moved from its inner second position to its outer first position by the retractor means being moved from the retractor means axial inner position to its axial outer position.

2. The drilling apparatus of claim 1 wherein the bushing has an opening extending axially therethrough that at least in part is defined by an axial outer frustoconical surface portion having an axial inner minor base and a minimum inner diameter axial intermediate portion and the valve assembly includes an axial inner valve member portion of increasing diameters in an axial outer direction to a maximum diameter section in a transverse plane perpendicular to the central axis and then of decreasing diameters, the maximum diameter section being of a greater diameter than the diameter of the bushing minimum diameter portion, the valve assembly inner valve member portion in the valve assembly second position being in abutting relationship to the frustoconical portion.

3. The drilling apparatus of claim 1 wherein the bushing has an opening extending therethrough that at least in part is defined by an axial outer frustoconical surface portion having an axial outer major base, an axially intermediate portion having a bushing minimum inner diameter and an inner frustoconical surface portion with its minor base axially outwardly of its major base, and the valve assembly includes a valve member having an axial intermediate maximum diametric section in a transverse plane perpendicular to the central axis.

4. The drilling apparatus of claim 3 wherein, when the valve assembly is in its second position, the valve member is axially movable relative to the bushing to a third position its diametric section is axially inwardly of the bushing intermediate portion.

5. The drilling apparatus of claim 4 wherein the diametric section is of a maximum transverse diameter that is greater than the minimum diameter of the bushing intermediate section.

6. The drilling apparatus of claim 5 wherein a spring is mounted in the bore for abutting against the valve member when its diametric section is inwardly of the bushing intermediate portion to urge it to abut against the inner frustoconical surface to block axial inward flow through the bushing and axially movable inwardly of the inner frustoconical surface under a preselected high pump-in fluid pressure to permit axial inward fluid flow through the bushing between the inner frustoconical surface and the diametric section, the valve member diametric section being movable axially outwardly through the bushing intermediate portion upon retracting the retractor means from its axial inner position to its axial outer position.

7. The drilling apparatus of claim 4 wherein the diametric section is of a maximum transverse diameter less than the minimum inner diameter of the bushing intermediate section.

8. The drilling apparatus of claim 7 wherein a spring is mounted in the bore for abutting against the valve member when its diametric section is inwardly of the bushing outer frustoconical portion and resiliently restraining further inward movement of the valve member to restrict axial inward flow through the bushing and permit the diametric section moving axially inwardly of the inner frustoconical surface under a preselected high pump-in fluid pressure to permit greater axial inward fluid flow through the bushing between the inner frustoconical surface and the diametric section, the valve member diametric section being movable axially outwardly through the bushing intermediate portion upon retracting the retractor means from its axial inner position to its axial outer position.

9. The drilling apparatus of claim 8 wherein the retractor means includes a retractor tube mounted for movement relative to the latch body between the retractor means positions, said retractor tube having an inner edge portion with an axial inner edge portion abuttable against the latch body enlarged diametric portion, the valving mechanism includes a transverse stem mount joined to the tube inner edge portion, the valve assembly includes an axially elongated valve stem having an inner end joined to the valve member and an axial outer end portion, the valve stem being of a smaller transverse cross sectional area than the bushing opening intermediate portion and the valve member diametric section, the stem mount and the valve stem having cooperating means mounting the stem mount for limited axial inward movement relative to the valve stem and as the retractor tube moves from its axial inner position to its axial outer position, retracting the valve stem which moves the valve member axially outwardly of the bushing to fully open the bypass channel as the retractor tube moves to its axial outer position.

10. The drilling apparatus of claim 1 wherein the bushing has an opening extending axially therethrough that in part is defined by a bushing axial outer frustoconical surface portion having an axial inner minor base and a minimum inner diameter axial intermediate portion and the valve assembly includes an axial inner valve member portion of increasing diameters in an axial outer direction to a maximum diameter section in a transverse plane perpendicular to the central axis and then of decreasing diameters, the maximum diameter section being a smaller diameter than the inner diameter of the bushing minimum diameter portion and the valving assembly includes spring means in the bore inwardly of the bushing for resiliently resisting the valve member moving inwardly of the bushing intermediate portion and the valve assembly inner valve member portion in the valve assembly second position being in abutting relationship to the spring means.

11. The drilling apparatus of claim 10 wherein the retractor means includes a retractor member mounted to the latch body for limited axial movement relative to the latch body, the valve mechanism includes a valve assembly mount mounted in fixed axial relationship to the retractor member and mounting the valve assembly for movement therewith and for limited axial movement relative thereto between the valve assembly second position abutting against the spring means to restrict axial inward fluid flow therethrough when the retractor means is in its axial inner position and be forced axially inwardly from the second position by fluid flowing inwardly under pressure to a third position further axially inwardly relative to the frustoconical surface against the resilient action of the spring means to permit axial inwardly fluid flow through the bushing.

12. The drilling apparatus of claim 11 wherein the bushing opening is in part defined by an axial inner frustoconical surface portion having an axial inner minor base, the retractor means in its axial inner position has a transverse inner edge abutting against the latch body diametric portion, the valve assembly includes a valve stem mounted to the valve assembly mount and having an inner end joined to the valve member portion, the spring means being of a resiliency that the valve assembly is movable under axial inwardly fluid pressure from its second position to a position axially inwardly of its second position that the valve member portion is inwardly of the bushing intermediate portion to permit increased fluid flow through the bushing, the valve assembly being connected to the retractor means for being moved from its second position to its first position as the retractor means is moved from its axial inner position to its axial outer position.

13. A drilling apparatus head assembly that is retractable axially outwardly and movable axially inwardly in a drill string that has a bit end at the inner end thereof, a latch seat adjacent to and axially outwardly of the bit end and a drill string landing shoulder axially adjacent to the latch seat, comprising an axially elongated latch body having a central axis, an enlarged diametric portion providing a latch body shoulder seatable on the drill string shoulder, a fluid bypass channel that includes a first port axially outwardly of the latch body shoulder, a second port axially inwardly of the latch body shoulder and an axially extending bore having the first and second ports opening thereto in axial spaced relationship, a latch mounted to the latch body for movement between a latch seated position and a retracted position permitting the latch body being retracted through the drill string, valving mechanism for controlling fluid flow through the bypass channel and retractor means extending axially outwardly of the enlarged diametric portion for retracting the latch body, said retractor means being mounted to the latch body for limited axial movement relative thereto between an axial inner position permitting the latch moving to its latch seated position and an axial outer latch retracted position for retracting the latch, said valving mechanism including a bushing mounted in the bore axially intermediate the opening of the first and second ports thereto, said bushing having an axial outer annular portion, an axial inner annular portion and an axial intermediate portion of a maximum transverse inner diameter that is less than the maximum transverse inner diameters of the bushing axial inner and outer portions, a valve member that is axially movable in the fluid channel and relative to the latch body between a retracted fluid bypass channel open first position and a second position axially inwardly of the first position and closely adjacent to the bushing outer portion to one of substantially restricting and blocking axial inward fluid flow through the bushing and a third position axially inwardly of the second position and extending inwardly of the bushing intermediate portion permitting axial inward fluid flow transversely between the valve member and the bushing inner portion, said valve member being movable inwardly from its second position to its third position by axial inward fluid pressure and connecting means for connecting the valve member to the retractor means for moving the valve member relative to the latch body from the valve member third position to the valve member first position as the retractor means is moved from its axial inner position to its axial outer position to permit increased inward fluid flow through the bushing.

14. The head assembly of claim 13 wherein the valve mechanism includes a spring mounted in the bore for abutting against the valve member after it has moved axially inwardly from its first position toward its second position to resiliently urge the valve member to move axially outwardly.

15. The head assembly of claim 13 wherein the connecting means includes a valve stem having an inner end joined to the valve member and mounting means for mounting the valve member to the retractor means to move the valve stem axially outwardly as the retractor means is moved from its axial inner position to its axial outer position and thereby move the valve member to its first position.

16. The head assembly of claim 15 wherein the bushing intermediate portion has a generally cylindrical, radial inner surface and the bushing inner and outer portions have generally frustoconical surfaces intersecting with the cylindrical surfaces with minor bases at the intersections with the cylindrical surface and axially remote major bases.

17. The head assembly of claim 16 wherein the valve member comprises an axial inner, partially spherical ball portion having a center of curvature and extending angularly through more than 180 degrees.

18. The head assembly of claim 17 wherein the ball portion has axial inner and outer portions and an intermediate section that in a plane of the center of curvature and perpendicular to the latch body central axis is of a diameter greater than inner diameters of the ball portions inner and outer portions.

19. The head assembly of claim 13 wherein the latch body has an axially elongated stem mount slot opening to the bore, and the connecting means includes a valve stem mount mounted in the stem mount slot for limited axial inward and outward movement relative thereto and mounted to the retractor means for movement therewith and a valve stem joined to the valve member in fixed relationship, said valve stem being mounted to the valve stem mount for being moved axially outwardly therewith.

20. The head assembly of claim 19 wherein the valve stem mount and the valve stem have cooperating means to permit limited relative axial movement that the stem mount is movable axially inwardly relative to the valve stem when the valve member is in its second position and the retractor means moves to its axial inner position, and with the valve member is in its third position, as the retractor means is retracted from its axial inner position to its axial outer position, the valve member is mechanically forced to move from its third position to its first position.

21. The head assembly of claim 19 wherein the retractor means includes a retractor tube axially movable relative to the latch body between an axial outer and an axial inner position, said retractor tube having a latch slot for the latch to extend radially outwardly therethrough when the retractor tube is in its axial inner position, said stem mount being attached to the retractor tube in a fixed axial position relative thereto and the retractor means includes an overshot coupling device mounted to the retractor tube for retracting the retractor tube relative to the latch body.

22. The head assembly of claim 21 wherein the latch body has an axially elongated retractor member slot and the retractor means includes a retractor member mounted to the retractor tube in fixed relationship thereto and movable axially inwardly and outwardly in the retractor member slot for, as the retractor tube is moved from its axial inner position to its axial outer position, moving the valve stem mount and therethrough, the valve stem and valve member to the valve member first position prior to the initial start of retraction of the latch body.

23. The head assembly of claim 21 wherein the latch body includes a main body portion and an axial inner portion removably mounted to the main body portion, the fluid bypass channel in part being in the main body portion and in part in the latch body inner portion, the latch body inner portion having the second port therein and the bushing seated therein and the main body portion having the first port and the stem mount slot therein.

24. Drilling apparatus having an axially extending central axis and being movable axially inwardly through a rotatable drill string toward a bit end of the drill string to a position adjacent to the bit end of the drill string to latchingly engage a drill string latch seat and being retractable axially outwardly through the drill string in a direction away from the bit end of the drill string, said drill string having a central axis and a landing shoulder axially adjacent to the bit end, comprising a longitudinally elongated latch body having a central axis, an axial outer end portion and an axial inner end portion, a latch assembly mounted to the latch body for movement between a latch seated position for releasably retaining the latch body in the drill string adjacent to the bit end and cooperating with the drill string when the drill string is rotated to rotate the latch body, and a latch release position permitting the latch body being retracted through the drill string, axially extending latch retractor means for retracting the latch assembly from its latch seated position and retracting the latch body, said latch retractor means being mounted to the latch body for limited axial movement between an axial inner latch seated position and an axial outer latch retracted position for movement therewith, a drilling tool mounted to the latch body inner portion, said latch body having a shoulder seatable on the drill string landing shoulder and, when seated on the drill string landing shoulder, substantially restricts fluid flow therebetween and a fluid bypass channel having a first port opening to the drill string axially outwardly of the latch body shoulder, a second port opening to the drill string axially inwardly of the latch body shoulder and a bore fluidly connecting the first port to the second port and defining a valve chamber axially intermediate the ports, and valving mechanism mounted in the chamber for controlling fluid flow through the bypass channel, said valving mechanism including a bushing mounted in the valve chamber, said bushing having an axially outwardly facing valve seat and an axially inwardly facing valve seat, a valve member mounted in the chamber, said valve member having a transverse axially inner, outer and intermediate sections, the intermediate section being of a larger diameter than the corresponding dimensions of the inner and outer transverse sections, the intermediate section being of a transverse cross sectional area for moving into the bushing axially inwardly of the bushing outer valve seat to one of substantially restricting axial inward fluid flow through the bushing and to block axial inwardly flow through the bore, spring means in the fluid bypass channel for abutting against the valve member in its inner position to resiliently urge the valve member axially outwardly, and connecting means connected to the latch retractor means for mechanically moving the valve member from the valve member inner position to its outer position when the latch retractor means is moved from its inner latch seated position to the latch retractor means outer latch retracted position.

* * * * *